US006793363B2

(12) United States Patent
Jensen

(10) Patent No.: US 6,793,363 B2
(45) Date of Patent: Sep. 21, 2004

(54) ILLUMINATED COASTER

(76) Inventor: Christopher A. Jensen, 1601 Stasi Ave., Raymore, MI (US) 64083

( * ) Notice: Subject to any disclaimer, the term of this patent is extended or adjusted under 35 U.S.C. 154(b) by 0 days.

(21) Appl. No.: 10/319,207

(22) Filed: Dec. 13, 2002

(65) Prior Publication Data

US 2004/0114352 A1 Jun. 17, 2004

(51) Int. Cl.[7] ..... F21V 33/00
(52) U.S. Cl. ..... 362/101; 362/154
(58) Field of Search ..... 362/101, 194, 362/800, 154, 802

(56) References Cited

U.S. PATENT DOCUMENTS 1,389,132 A * 8/1921 Galavan ..... 362/101
2,745,947 A * 5/1956 Sansous ..... 362/109
3,878,386 A * 4/1975 Douglas ..... 362/101
4,336,574 A * 6/1982 Goodman ..... 362/101
4,344,113 A * 8/1982 Ditto et al. ..... 362/101
4,858,084 A * 8/1989 Sheryll ..... 362/101
5,307,250 A * 4/1994 Pearson ..... 362/101
6,065,848 A * 5/2000 Tucker et al. ..... 362/101
6,092,905 A * 7/2000 Koehn ..... 362/101
6,305,817 B1 * 10/2001 Johnston et al. ..... 362/154
6,345,711 B1 * 2/2002 Sullivan ..... 192/107 R
6,371,624 B1 * 4/2002 Dorney ..... 362/34

* cited by examiner

*Primary Examiner*—John Anthony Ward
(74) *Attorney, Agent, or Firm*—Mark E. Brown

(57) ABSTRACT

An illuminated coaster includes a base with a body having upper and lower ends and a generally frusto-conical configuration enclosing a compartment. A resilient, insulative sleeve comprising foam rubber, polyurethane or some other suitable material is mounted on the body upper end and forms a container receiver adapted to selectively receive the lower end of a container. A lighting system is located generally in the compartment and includes a power source, such as a battery set. A light source is selectively connected to the battery set through a switching component and can comprise a bulb and socket or an LED, either of which can be mounted below the transparent lens for projecting light upwardly into a container in the container receiver. Modified embodiments of the illuminated coaster include horizontal/annular, helical and vertical ribs located on the inside of the sleeve for engaging a container received therein.

5 Claims, 4 Drawing Sheets

ILLUMINATED COASTER

BACKGROUND OF THE INVENTION

1. Field of the Invention

The present invention relates generally to beverageware, and in particular to an illuminated coaster for beverage vessels, which can optionally include graphic displays.

2. Description of the Prior Art

Consuming beverages is a universal activity, which occurs in many settings and involves a wide variety of beverages. The variety of vessels from which beverages are consumed is also extensive. For example, open vessels include various cups, glasses and other containers. They are also commonly sold in and consumed from closable containers, such as cans and bottles.

Different types of beverages are customarily served at different temperatures. For example, those which are served cold, either pre-chilled or on ice, account for a significant portion of consumed beverages. Common pre-packaged examples include carbonated soft drinks, "bottled" water, beer, wine, etc.

Vessels for cold beverages are commonly equipped or used with condensation control devices. Typical examples included insulated and double-walled containers, which tend to prevent condensation on their outside surfaces. Single-walled, non-insulated vessel materials, such as glass, porcelain and plastic, are susceptible to external condensation. Such external condensation can be controlled with paperware and insulating sleeves of a type commonly made from insulative foam materials.

Coasters are also commonly used in conjunction with drinking vessels. They are typically made of insulating or moisture-absorbing materials for placement under the vessels. Coasters are commonly used to protect tabletops and other flat surfaces from moisture damage, such as condensation, which would otherwise collect at the bottom of uninsulated containers.

In addition to containing beverages until consumed, beverageware can serve an important commercial function. It provides display space for advertising, brand identification, commercial designs, "product placement" information and other commercial messages. For example, coasters, napkins, cups and glasses are often pre-printed with product labels and other commercial messages. Cans and bottles are also commonly labeled for this purpose. Although such conventional applied graphics can be effective, in many situations they go unnoticed. For example, in low ambient lighting level conditions such commercial messages may be difficult to read and discern.

Heretofore there has not been available an illuminated coaster adapted for illuminating a bottle or other transparent/translucent container from underneath, with the advantages and features of the present invention.

SUMMARY OF THE INVENTION

In the practice of the present invention, an illuminated coaster is provided which includes a base assembly forming a compartment for a lighting system. The base assembly includes a sidewall adapted to receive and display printed messages and other graphics. The lighting system includes a power source, such as a battery pack, a light output device, such as a bulb or an LED, and a switching component. An insulative sleeve is mounted on top of the light output device and receives the beverage container, which is thus positioned for infusion of light from the light output device.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
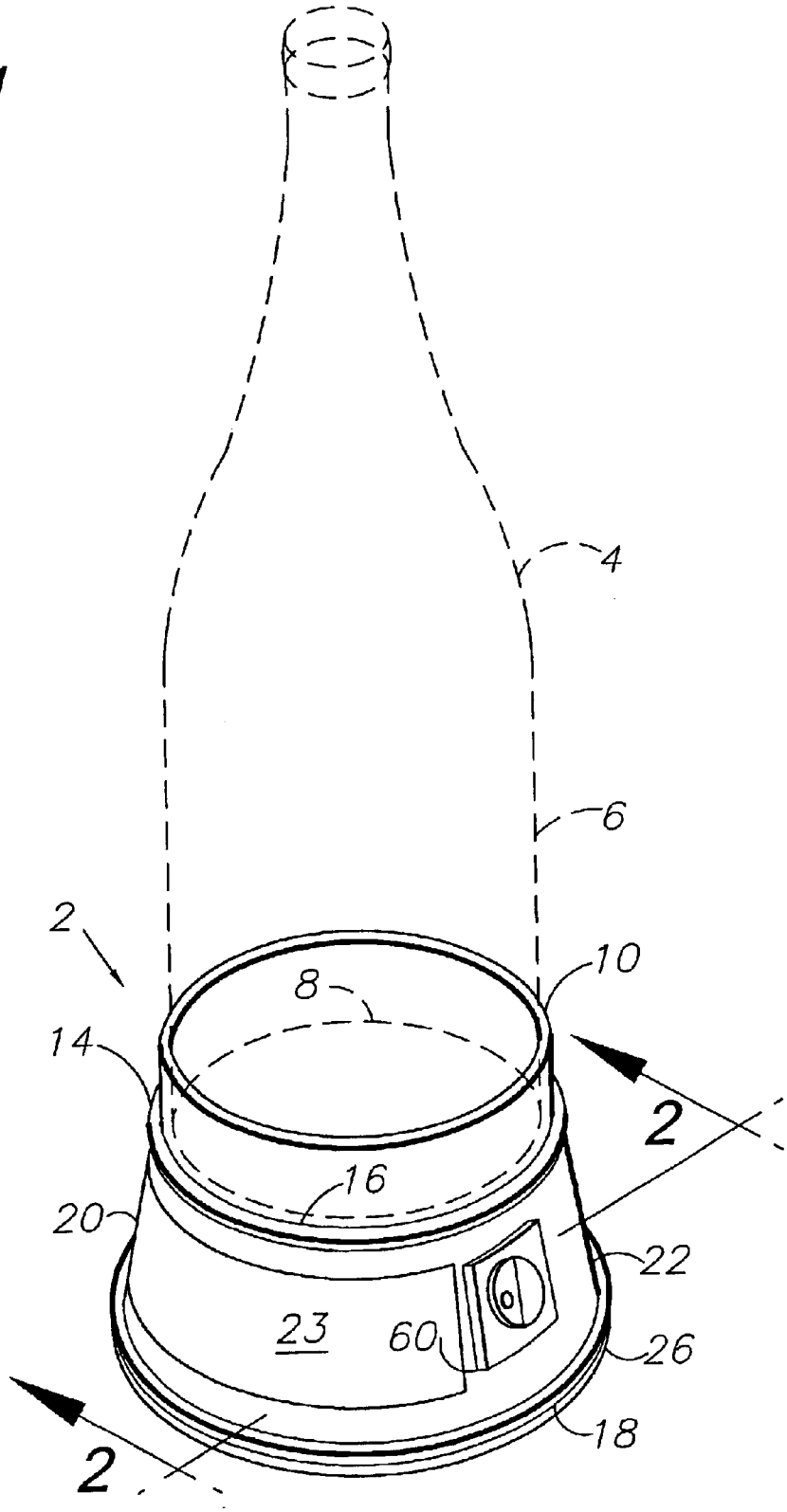
FIG. 1 an upper, perspective view of an illuminated coaster embodying the present invention.
Figure 2:
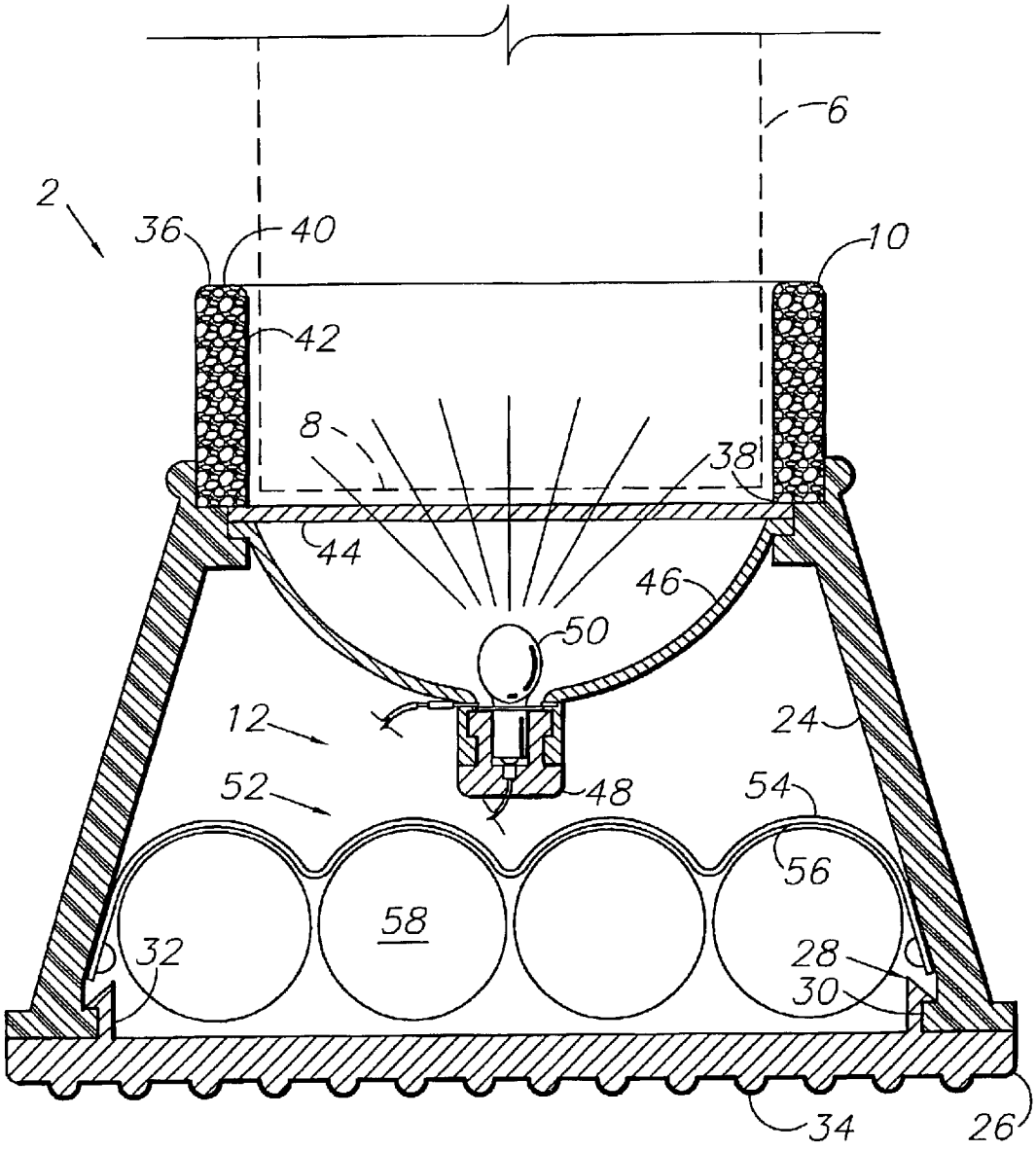
FIG. 2 is an enlarged cross-sectional view thereof taken generally along line 2—2 in FIG. 1.

Certain terminology will be used in the following description for convenience in reference only and will not be limiting. For example, up, down, front, back, right and left refer to the invention as oriented in FIG. 1. The words "inwardly" and "outwardly" refer to directions toward and away from, respectively, the geometric center of the embodiment being described and designated parts thereof. Said terminology will include the words specifically mentioned, derivatives thereof and words of similar import.

II. Preferred Embodiment Illuminated Coaster 2

Referring to the drawings in more detail, the reference numeral 2 generally designates an illuminated coaster embodying the present invention. Without limitation on the generality of useful applications of the coaster 2, a bottle 4 with a sidewall 6 and a bottom 8 is placed therein. The coaster 2 generally includes a base assembly 10 and a lighting system 12.

The base assembly 10 includes a plastic body 14 with upper and lower ends 16, 18 respectively and a sidewall 20 with a generally frusto-conical configuration and an outer surface 22, which provides a display area 23 adapted to receive "product placement" information, graphics, markings, etc. The body 14 encloses a compartment 24. A non-slip bottom plate 26 is mounted on the body lower end 18 by a mounting mechanism 28 comprising lugs 30 extending into the compartment 24 from the body sidewall 20 and hooks 32 extending upwardly from the bottom plate 26 and releasably engaging the lugs 30. The bottom plate 26 includes ribs 34, which can resist sliding by providing additional traction engagement for the coaster 2.

A tubular sleeve or beverage bottle retaining ring 36 includes a lower end 38 mounted in the body upper end 16 and an open upper end 40. The sleeve 36 preferably comprises a resilient, insulative foam material, such as polyurethane. The sleeve 36 forms a receiver 42 adapted to receive the bottle sidewall 6 adjacent to the bottle bottom 8.

Figure 6:
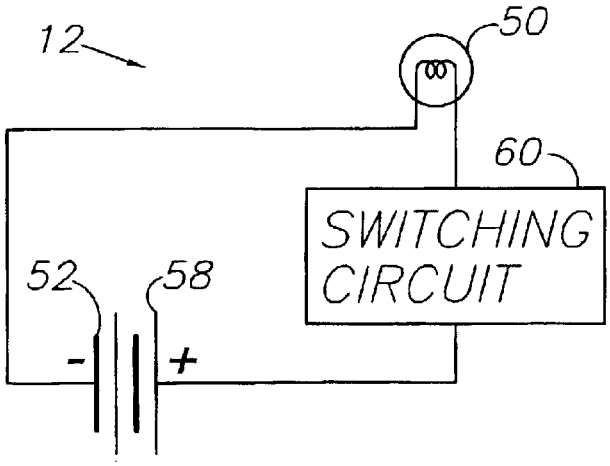
FIG. 6 is a circuit diagram of the lighting/illumination system.

The lighting system 12 includes a lens 44 mounted in the body upper end 16 against the sleeve lower end 38. A concave reflector 46 is located below the lens 44 and mounts a socket subassembly 48, which mounts a bulb 50. A power source 52 comprises a battery case 54 with multiple (e.g. 4 are shown) battery receivers 56 each adapted to receive a respective electrical storage battery 58, such as 4 "AA" batteries, which can be series and/or parallel wired to provide 1.5V, 3V or 6V nominal potential. Other battery combinations, such as 2 "C" cells, can also be used. A switching circuit 60 (FIG. 6) includes open and closed positions for selectively disconnecting and connecting the bulb 50 to the power source 52. The switching circuit 60 is mounted on the body sidewall 20 and is operable from the exterior of the body 14.

III. Operation

In operation, the coaster 2 receives a bottle 4, which is preferably grippingly engaged by the sleeve 36 whereby the coaster 2 is releasably retained on the bottle 4. The sleeve 36 provides a certain amount of insulation for the contents of the bottle 4, which can contain a chilled beverage. With the switching circuit 60 in its closed position, the bulb 50 is illuminated and light shines upwardly through the lens 44 and the bottle 4. The liquid contents of the bottle 4 preferably transmit the lighting from underneath, whereby the entire bottle 4 can appear to "glow". Naturally, at low lighting levels the lighted bottle 4 can attract considerable attention, thereby enhancing the marketing and promotional function of same.

In addition to the manual on-off switch, the switching circuit 60 can comprise various electronic devices, including programmable switching components for sequentially flashing and for other lighting effects. For example, the switching circuit 60 can be preprogrammed to activate at a certain time or in response to an internal or an external signal. Such a signal might be generated when the device is lifted (e.g., through a momentary contact switch), by remote control, on a timer, etc. The batteries 58 can be changed or recharged by removing the bottom plate 26 to access the compartment 24.

IV. First Modified Embodiment Illuminated Coaster 102

Figure 3:
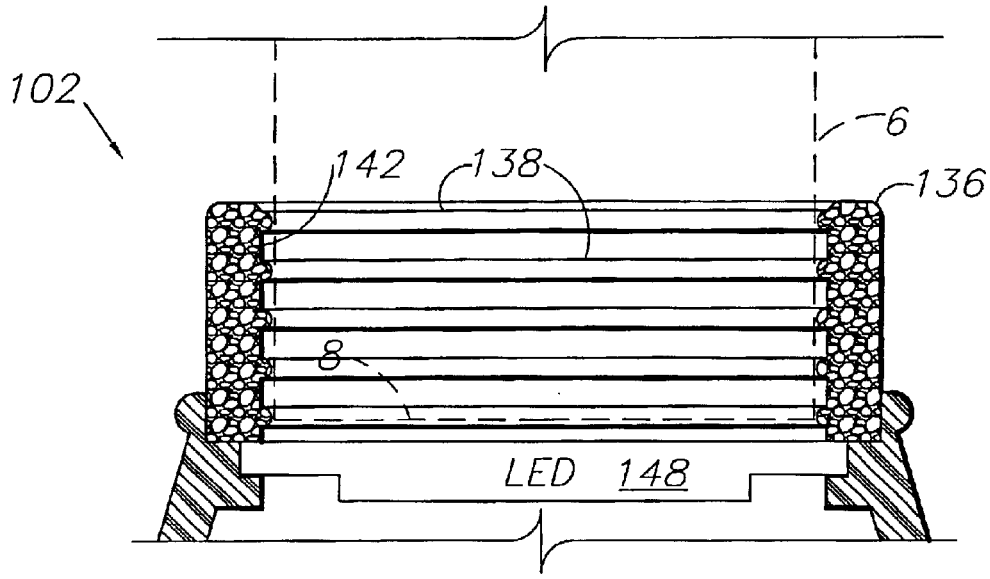
FIG. 3 is an enlarged, fragmentary, cross-sectional view of a first modified embodiment with annular ribs formed in a sleeve thereof.

An illuminated coaster 102 comprising a first modified embodiment of present invention is shown in FIG. 3 and includes a modified sleeve 136 with multiple, annular ribs 138 extending into a receiver 142 and adapted for grippingly engaging the bottle 4. The light source comprises an LED 148. Otherwise the illuminated coaster 102 performs substantially the same as the illuminated coaster 2.

V. Second Modified Embodiment Illuminated Coaster 202

Figure 4:
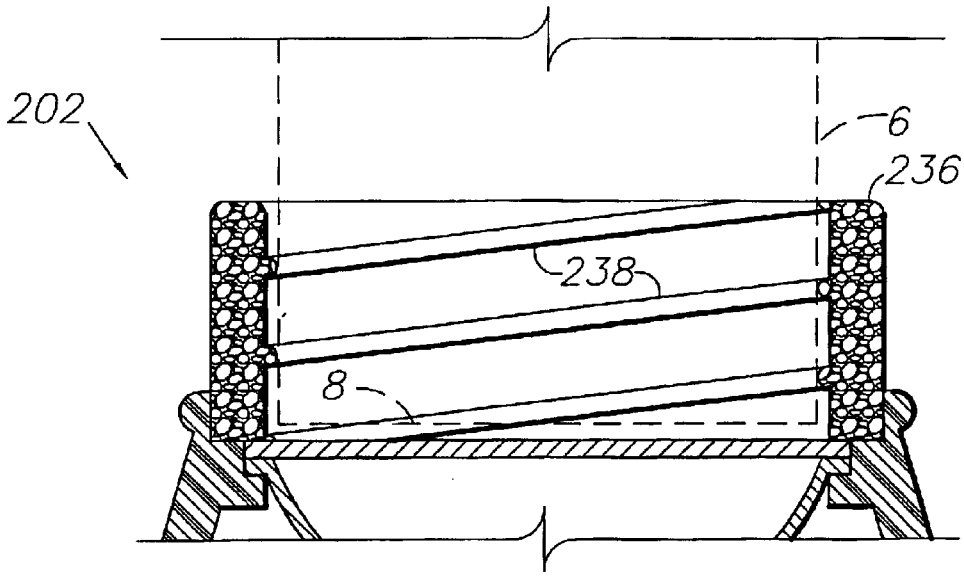
FIG. 4 is an enlarged, fragmentary, cross-sectional view of a second modified embodiment with helical ribs formed in a sleeve thereof.

An illuminated coaster 202 comprising a second modified embodiment of the present invention is shown in FIG. 4. The coaster 202 includes a modified sleeve 236 with helical ribs 238 projecting inwardly into the sleeve receiver 242. Bottles 4 can thus be twisted into and out of the sleeve receiver 242.

IV. Third Modified Embodiment Illuminated Coaster 302

Figure 5:
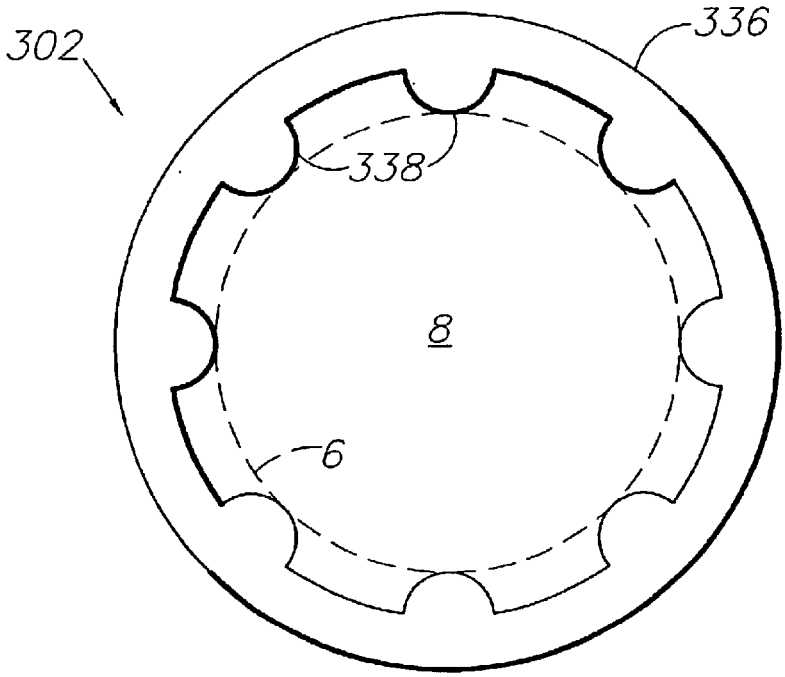
FIG. 5 is an enlarged, fragmentary, top plan view of a third modified embodiment with vertical ribs formed in a sleeve thereof.

An illuminated coaster 302 comprising a third modified embodiment of the present invention is shown in FIG. 5 and includes a modified sleeve 336 with multiple, vertical ribs 338 extending into a receiver 142 and adapted for grippingly engaging the bottle 4.

It is to be understood that the invention can be embodied in various forms, and is not to be limited to the examples discussed above.

Having thus described the invention, what is claimed as new and desired to be secured by Letters Patent is:

1. An illuminated coaster for a translucent beverage container with a sidewall and a bottom, which coaster includes:

a base assembly including a body with upper and lower ends and a generally frusto-conical sidewall with an exterior surface, said sidewall enclosing a compartment;

said base assembly further including a generally tubular sleeve with upper and lower open ends and a generally tubular configuration forming an upwardly-open container receiver adapted to receive said container bottom and sidewall adjacent to said container bottom, said sleeve comprising an insulative, resilient foam material and including multiple ribs projecting inwardly into said receiver;

said base assembly further including a bottom plate adapted for selectively covering said body lower end;

a bottom plate mounting mechanism including multiple lugs on said body sidewall projecting into said compartment and multiple hooks extending upwardly from said bottom plate and adapted for selectively engaging respective said lugs; and a lighting system including a power source comprising a battery container mounted in said compartment and including multiple battery receivers each adapted to receive a respective battery, a lens mounted in said body upper end at said sleeve lower end, a reflector mounted in said compartment below said lens, said reflector being oriented generally upwardly, a socket and bulb mounted in said reflector and selectively connected to said power source and a switch mounted on said body sidewall and accessible at the exterior surface thereof, said switch having a closed positioned connecting said power source and said bulb and an open position disconnecting same.

2. The invention according to claim 1 wherein said lighting system includes a programmable controller connected to said power source and said bulb.

3. The invention according to claim 1 wherein said ribs are generally annular and horizontal, and are positioned in spaced relation in the interior of said sleeve.

4. The invention according claim 1 wherein said ribs extend generally vertically in spaced relation along the interior face of said sleeve.

5. The invention according claim 1 wherein said ribs are helical and extend along the interior face of said sleeve between its top and bottom.

* * * * *